US005568855A

United States Patent [19]

Hoffman et al.

[11] Patent Number: 5,568,855

[45] Date of Patent: Oct. 29, 1996

[54] COIN DETECTOR AND IDENTIFIER APPARATUS AND METHOD

[75] Inventors: Kirk D. Hoffman, Yorkville; Joe Ferrantelli, Orland Park; Robert Huizenger, Woodridge, all of Ill.

[73] Assignee: Coin Mechanisms, Inc., Glendale Heights, Ill.

[21] Appl. No.: 537,971

[22] Filed: Oct. 2, 1995

[51] Int. Cl.[6] ..... G07D 5/08

[52] U.S. Cl. ..... 194/318; 194/203

[58] Field of Search ..... 194/202, 203, 194/204, 212, 213, 317, 318, 334, 344, 346

[56] References Cited

U.S. PATENT DOCUMENTS

| | | | |
|---|---|---|---|
| 3,599,771 | 8/1971 | Hinterstocker | 194/318 |
| 4,437,558 | 3/1984 | Nicholson et al. . | |
| 4,469,213 | 9/1984 | Nicholson et al. . | |
| 4,574,936 | 3/1986 | Klinger | 194/318 |
| 4,690,263 | 9/1987 | Yokomori | 194/317 |
| 5,056,644 | 10/1991 | Parker | 194/318 |
| 5,433,310 | 7/1995 | Bell | 194/318 |

FOREIGN PATENT DOCUMENTS

| | | | |
|---|---|---|---|
| 2654126 | 6/1978 | Germany | 194/317 |
| 8400073 | 1/1984 | WIPO | 194/318 |

*Primary Examiner*—Karen Merritt
*Assistant Examiner*—Scott L. Lowe
*Attorney, Agent, or Firm*—Leydig Voit & Mayer, Ltd.

[57] ABSTRACT

A coin detection and identifying apparatus and method, utilizes three closely aligned electric coils. The center coil is actively driven by an alternating current to generate a magnetic field that surrounds the center coil. The two outer coils are symmetrically disposed within the magnetic field generated by the center coil, and voltages are induced across the terminals of the outer coils which are indicative of the relative field strengths of the magnetic fields within the outer coils. A sample coin and test coin are interposed between the center coil and each of the outer coils, the coins operative to attenuate the surrounding magnetic fields. A controller compares the voltages across the terminals of the two outer coils to effectively compare the likeness of the sample and test coins. A coin sensing apparatus, located downstream of the coils, provides a plurality of optic emitter-detector pairs to detect the valid passage of a coin. The plurality of emitter-detector pairs are disposed to provide improved resistance to miscounting of coins and traditional gimmicks, such as tilting the device, used to cheat coin operated devices.

20 Claims, 9 Drawing Sheets

COIN DETECTOR AND IDENTIFIER APPARATUS AND METHOD

FIELD OF THE INVENTION

The present invention generally relates to coin testing devices, and more particularly to an improved device for identifying a test coin by comparison to a sample coin.

BACKGROUND OF THE INVENTION

There is a wide variety of coin-operated devices that utilize some mechanism for identifying valid coins; vending machines, slot machines, and arcade video machines just to name a few. There are also many ways to circumvent the proper operation of these machines. For example, slugs, foreign coins, tilting the device, and the retrievable coin-on-a-string routine are traditional gimmicks that have been employed over the years to cheat various coin-operated devices. Accordingly, a variety of coin testing devices have been designed in an attempt to defeat these and other gimmicks.

Indeed, over the years, a number of coin identifier devices have been designed. Simple identifiers have included detecting the size and/or the weight of the inserted coin, but are often susceptible to one or more of the commonly known cheating devices. For example, a coin identifying mechanism that operates by detecting coin size is susceptible to slugs or foreign coins having a similar size. Likewise, coin identifying mechanisms that operate by detecting the weight of an inserted coin are also susceptible to both slugs and foreign coins.

Coin detector and identifying systems that utilize magnetic fields are known to provide excellent detection and matching capability, and are not easily defeated by the traditional cheating gimmicks. An example of a magnetic field-type coin detector is disclosed in U.S. Pat. Nos. 4,437,558 and 4,469,213, both assigned to the assignee of the present invention and incorporated herein by reference. The coin detection device disclosed in the '213 patent utilizes three aligned electric coils. The two outer coils are electrically connected in series with an oscillator circuit. The oscillating current within these coils establishes a magnetic field about each coil. Since the current through the series connected coils is the same, the magnetic fields established about each of these two coils is identical. The center coil is passively connected to an amplifier, the output of which is an amplified indication of the magnetic field established within the center coil. The outer coils are aligned with the center coil in opposing relation, so that the electric fields generated by the two outer coils generally cancel in the region of the center coil, leaving a net electric field of zero within the inner coil. Accordingly, no voltage is induced at the terminals of the center winding, indicating a matched condition about the center coil.

A sample coin (of any type) is physically disposed between the center coil and one of the two outer coils, thereby interrupting the electro-magnetic field established therebetween. More specifically, the coin (due to its physical characteristics) will attenuate the magnetic field in the region of the coin. As a result, the opposing electric fields from the two outer coils is no longer centrally balanced, and a net electric field exists within the center coil. Thus, a voltage is induced across the terminals of the center winding, driving the amplifier to saturate.

Coins inserted by a user into the coin-operated device are routed through a chute so as to pass through the space physically separating the center coil and the opposing outer coil. When the sample coin and test coin differ both in size and in structure (e.g., material composition) a net magnetic field remains in the centrally disposed coil. When, however, the coins identically match, the net magnetic field within the central coil is substantially zeroed out. This condition signals a valid and identified coin which may then be accepted by the device.

While the coin detector and identifier circuit of the '213 patent provides an effective means of detecting and identifying coins, it is known to be susceptible to electromagnetic interference (EMI). Indeed, in recent years the proliferation of transmitting devices such as cellular telephones has been tremendous. As a result, occasional failures occur in the coin detector and identifier described in the '213 patent. To illustrate this failure, consider a test coin inserted in the machine that precisely matches the sample coin. In the absence of electromagnetic interference, the net magnetic field within the center coil has a net magnitude of zero (or substantial zero). If, however, extraneous electromagnetic interference is present, a net magnetic field within the center coil will be present. If the magnitude of the EMI is sufficiently great, the coin detector and identifier may improperly reject an otherwise valid coin (false failure). Accordingly, improvements are sought to be made to the coin detector circuitry of the '213 patent.

Another area in which the mechanism of the '213 patent is sought to be further improved relates to device circumvention achieved by either tilting the coin operated device or defeating its proper operation by use of the coin-on-a-string gimmick. An otherwise valid test coin may be inserted in the machine but attached to a string in a manner that, once properly identified by the detection circuitry, may be jerked back and removed from the machine. Alternatively, if the coin-operated device is small enough it may be shaken or tilted. This may lead to improper multiple counts of a single coin. That is, once a test coin has been sensed and identified by the detector circuitry, improperly tilting the coin-operated device may cause the coin to back up and pass through the sensing circuitry again, affectively double-counting the single coin and, thus, circumventing the proper operation of the coin-operated device. Accordingly, it can be appreciated that an improved coin detector and identifying machine is desired. More specifically, it is desired to provide a coin detection and identifying machine that offers improved resistance to the traditional gimmicks, but is also desensitized to high levels of electromagnetic interference.

SUMMARY OF THE INVENTION

Accordingly, it is the primary aim of the present invention to provide an improved coin detection and identifying mechanism that affectively identifies test coins in comparison to a sample coin.

A more specific object of the present invention is to provide a coin detection and identifying mechanism that affectively identifies a test coin, in comparison to a sample coin, and that is substantially unaffected by electromagnetic interference.

Another object of the present invention is to provide a coin detection and identifying mechanism that effectively identifies a test coin (in comparison to a sample coin) and that has improved resistant to traditional cheating or circumvention gimmicks.

Yet another object of the present invention is to provide a coin detection and identifying apparatus and method that effectively guards against gimmicks that may result in double-counting of test coins.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, the present invention is generally directed to a coin detector and identifier for a coin operated device. The detector includes a field generating means for generating an alternating magnetic field, which is characterized by a central, concentrated region and a disperse region outside the central region, the field generating means being disposed in the central region. First and second field detection means are also included and detect the magnitude of the magnetic field. It is important that the first and second field detection means are symmetrically disposed about the field generating means. Comparing means responsive to the first and second field detection means are provided for comparing the magnitude of the magnetic fields detected by the first and second field detection means.

Means are provided for disposing a sample coin between the field generating means and the first field detection means, the sample coin operative to alter the magnitude of the magnetic field detected by the first field detection means by an amount defined by the physical characteristics of the sample coin, such as mass and material composition. Further means are provided for disposing a test coin between the field generating means and the second field detection means. Like the sample coin, the test coin operates to alter the magnitude of the magnetic field detected by the second field detection means by an amount defined by the physical characteristics of the test coin. Finally, coin directing means, responsive to the comparing means, are provided for directing the test coin, and the directing means are operative to accept test coins that match the sample coin and to reject test coins not matching the sample coin.

In accordance with another aspect of the present invention, a coin sensing, or tracking, apparatus is provided. The coin sensing apparatus includes a plurality of sensing means for detecting the presence of a test coin, wherein the plurality of sensing means including first and second sensing means. Guide means are provided for directing a test coin past the plurality of sensing means, the test coin traversing along a substantially linear path. Indeed, the path traversed by the test coin is defined by a centerline coincident with the center of the test coin and first and second outer boundaries disposed on either side of the centerline and coincident with the diametrical edges of the test coin. The first sensing means is generally disposed between the centerline and the first outer boundary, and the second sensing means is generally disposed between the centerline and the second outer boundary. Furthermore, the first and second sensing means are linearly offset with respect to, or along the direction of, the centerline.

A control circuit, which is responsive to the first and second sensing means, is provided to analyze the travel path of the test coin. Coin directing means, responsive to the processing means, are configured to accept the test coin if the processing means indicates that the test coin has traversed a valid travel path, and to reject the test coin if the processing means indicates that the test coin has traversed an invalid travel path.

In a preferred embodiment of the present invention, four sensing means are provided for sensing and analyzing the travel path of the test coin. In this preferred embodiment, two of the sensing means are disposed generally between the centerline and the first outer boundary, and two of the sensing means are disposed generally between the centerline and the second outer boundary.

In accordance with a further aspect of the present invention, a method for identifying a coin in a coin operated device is provided. The method includes the steps of generating a magnetic field with a centrally disposed coil, and positioning first and second magnetic field detection means symmetrically within the magnetic field generated by the centrally disposed coil. Other steps include disposing a sample coin between the centrally disposed coil and the first field detection means, and thereafter disposing a test coin between the centrally disposed coil and the second field detection means. It is understood that the test coin is disposed in a symmetric manner with the sample coin. Then, the magnitude of the magnetic field detected by the first and second field detection means are compared, and the test coin is directed, or discriminated, by accepting the test coin if the magnitudes of the magnetic fields detected by the first and second field detection means are substantially the same and rejecting the test coin if the magnitudes of the magnetic fields detected by the first and second field detection means are not substantially the same.

BRIEF DESCRIPTION OF THE DRAWINGS

The accompanying drawings incorporated in and forming a part of the specification, illustrate several aspects of the present invention, and together with the description serve to explain the principles of the invention.

DETAILED DESCRIPTION OF THE PREFERRED EMBODIMENTS

Figure 1:
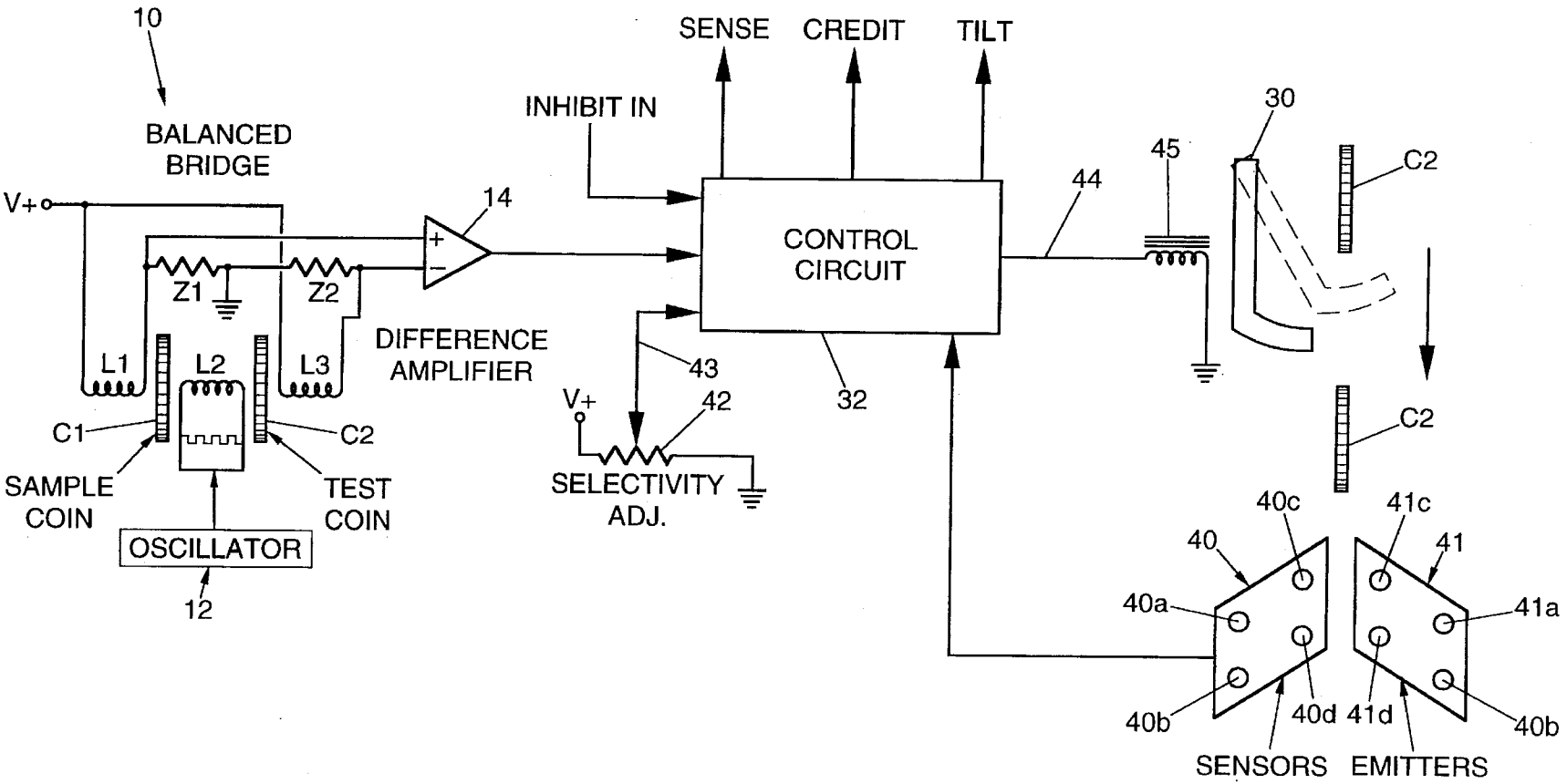
FIG. 1 is a diagram illustrating the principal components of a coin detector and identifier in accordance with the present invention.

A coin detector and identifying apparatus and method are illustrated in the drawings. Preferably, the coin detector and identifier is directed for use in a coin operated device designed to accept a single type of coin. For example, a slot machine designed to accept only quarters, or an arcade or other gaming machine designed to accept a particular token. It can be appreciated that a wide variety of devices are presently known which could utilize the present invention in its preferred embodiment. Moreover, and consistent with the concepts and teachings of the present invention, the illustrated embodiment may be readily adapted for use in coin operated devices designed to accept a plurality of different types of coins. For example, a vending machine designed to accept quarters, nickels, and dimes.

In accordance with one aspect of the present invention, a coin detector is provided and is configured to compare a test coin with a sample coin, and when the two are determined to be identical, accepts the test coin as a valid input coin. In instances where the test coin does not match (within a predetermined tolerance range) the sample coin, then the test coin is rejected, as by way of a coin return on the coin operated device. This provides a ready indication to a user that the coin was not accepted by the coin operated device. Advantageously, this not only returns the coin to the user but also prevents the coin operated device from accumulating slugs, tokens, washers and other foreign objects.

In accordance with another aspect of the present invention, a coin identifier is provided preferably downstream of the coin detector. The coin identifier includes at least two sensors which are offset both axially and laterally from the travel path of the test coin, and are electrically connected to a processor or control circuit. In a manner that will be described in further detail below, the processor analyzes the signals generated by the sensors to determine whether a test coin has properly traversed the path. As will become apparent from the discussion that follows, the coin identifier effectively counts coins that are inserted by detecting invalid test coin paths, which typically occur when a user is attempting to cheat a coin operated device by tilting, retrieving a coin with a string, or employing some other common gimmick.

To more specifically describe the preferred embodiment, reference is made to FIG. 1 which shows the general layout of the coin detector and identifier. The coin detector, generally designated by reference numeral 10, includes three coils L1, L2 and L3 in connection with an oscillator 12 and an amplifier 14. Indeed, coil L2 preferably forms a portion of oscillator 12. In this regard, reference is briefly made to FIG. 2 which shows the oscillator circuit of the preferred embodiment.

Figure 2:
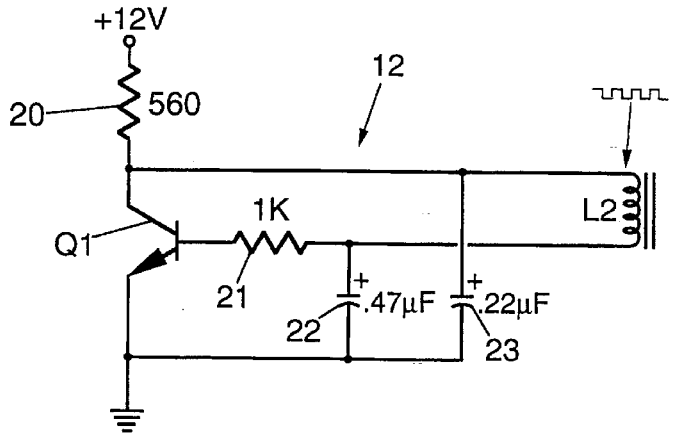
FIG. 2 is a schematic diagram showing a transistor oscillatory circuit.

The oscillator circuit of FIG. 2 utilizes the energy storage capabilities of coil L2 to achieve the oscillatory characteristics of the current passing through coil L2. This type of oscillator configuration is know in the art as a Colpitts oscillator. Specifically, when power (12 volts) is initially applied to the circuit, transistor Q1 is in the OFF state. Therefore, current sourced by the 12 volt power supply passes through resistor 20, the parallel paths of capacitor 23 and coil L2 and, initially, through capacitor 22. The current passing through capacitor 22 produces a voltage drop across a capacitor, which, in turn, results in a voltage drop across the resistor 21 and the base-emitter junction of transistor Q1. As a result, transistor Q1 transitions to the ON state. Thereafter, current sourced from the voltage source passes through resistor 20 and transistor Q1 to ground.

When transistor Q1 is ON, current no longer passes through coil L2, and the coil L2 transitions from a load to a source component. That is, as current initially passes from the voltage source through the coil L2, the coil L2 acts as a load and stores energy in its magnetic field. As the current from the voltage source is directed through transistor Q1, the magnetic field within the coil begins to collapse, thereby inducing a voltage of opposite polarity across the terminals of the coil and sourcing current (still through capacitor 22) until the energy stored in the coil L2 has dissipated. At that time, the voltage across capacitor 22 will drop to zero and transistor Q1 will turn OFF. Thereafter, current source from the voltage source will again be directed through resistor 20, capacitor 23 and coil L2, and capacitor 22 as previously described.

This process repeats indefinitely, first driving a positive current through coil L2, followed by a period of substantially zero current through coil L2. The numerical values illustrated for the resistors 20 and 21 and capacitors 22 and 23 reflect the preferred embodiment, which results in a current having an oscillatory frequency of approximately 8.5 kilohertz. It will be appreciated by those skilled in the art that the component values may be varied to effect a controlled oscillatory frequency of values other than 8.5 kilohertz. Indeed, depending upon the particular coil properties and alloys comprising the coins or tokens to be identified, different frequencies may be preferred. Broadly, however, it is preferred to maintain the oscillatory frequency below 50 kilohertz, due to the adverse consequences of EMI radiation at higher frequencies of operation.

Figure 3:
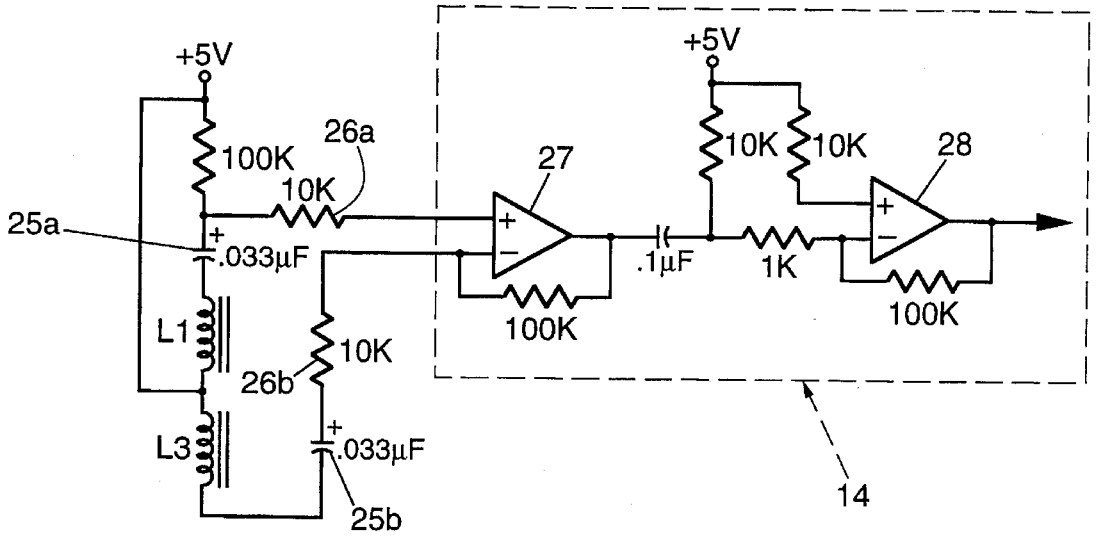
FIG. 3 is a schematic diagram showing amplifier and bridge circuitry in accordance with a preferred embodiment of the present invention.
Figure 9A:
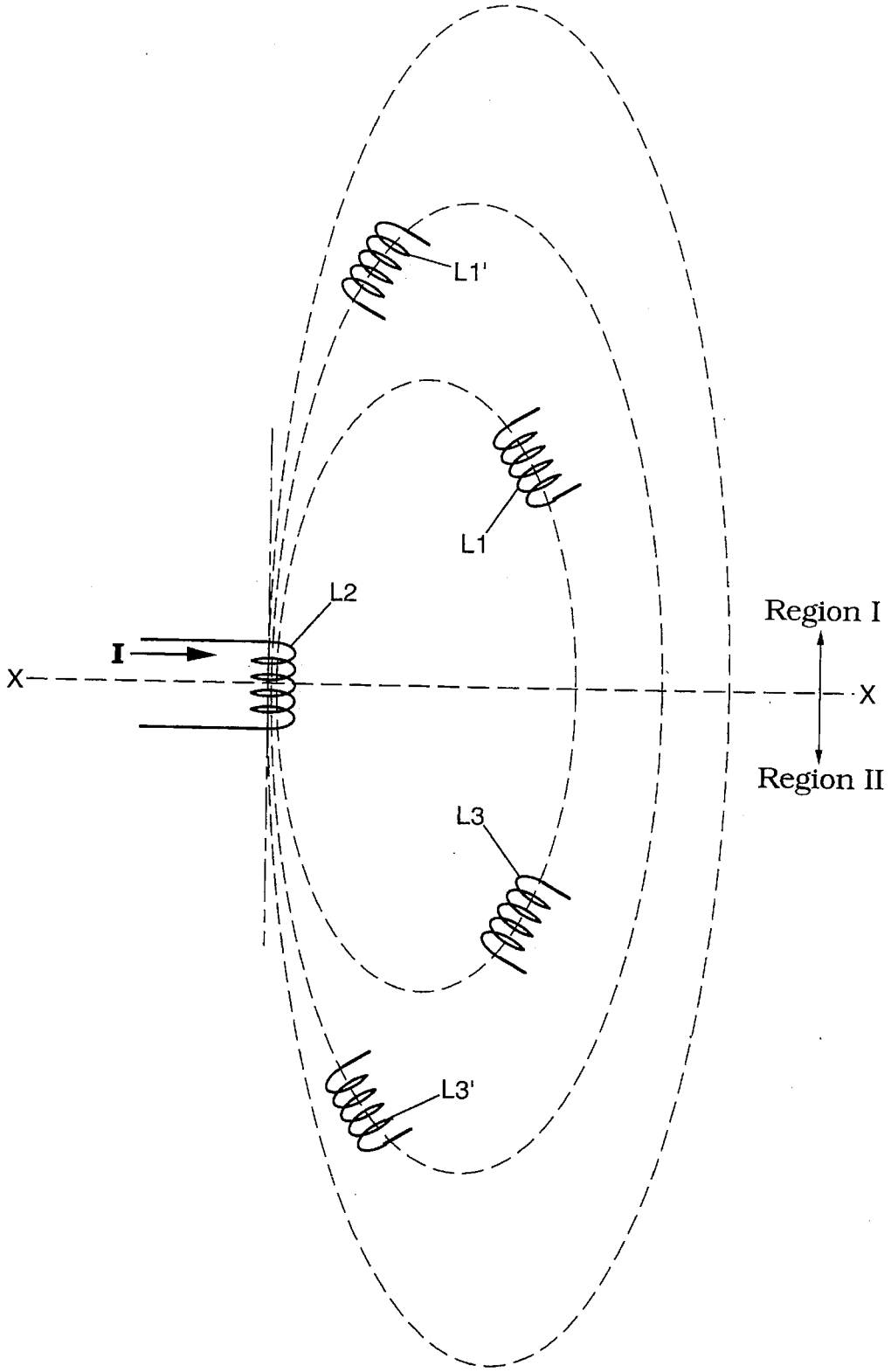
FIG. 9A is a diagram illustrating the magnetic field generated by current passing through a coil of wire, and further illustrating alternative dispositions of field detectors in accordance with the present invention.
Figure 9B:
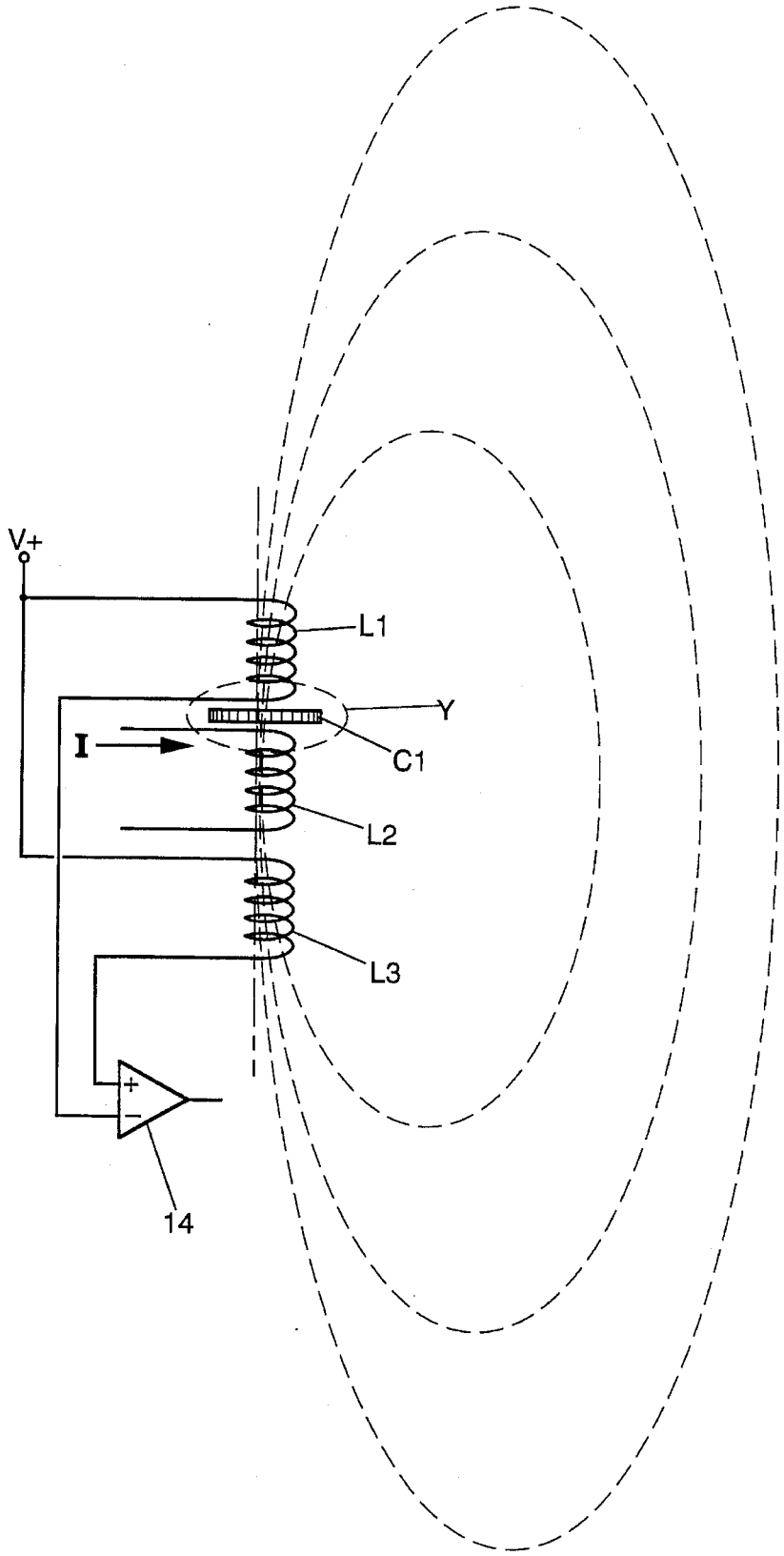
FIG. 9B is a diagram illustrating the preferred dispositions of field detectors.

As illustrated in FIG. 1, coils L1 and L3 are preferably aligned with coil L2 and disposed on either side thereof. Coils L1 and L3 are interconnected with impedances Z1 and Z2 in a balanced bridge configuration and are further connected with differential amplifier 14. As will be understood, the impedances Z1 and Z2 are realized by resistor-capacitor combinations, and the detailed schematic diagram for this configuration is shown in FIG. 3. As illustrated, coils L1 and L3 share a common terminal that is electrically connected to 5 volts DC. The opposing terminals of each coil L1 and L3 are series connected through capacitors 25*a* and 25*b*, resistors 26*a* and 26*b*, and then to inputs of the differential amplifier 14. It can be appreciated from the schematic diagram of FIG. 3 that the voltage levels of the signals passing into differential amplifier 14 will tend to be equal. Significantly, the voltage levels at the two inputs to differential amplifier 14 will be affected by the magnetic fields within coils L1 and L3. To better understand how the magnetic field within coils L1 and L3 behave, reference is made to FIGS. 9A and 9B, which illustrate the magnetic field generated by current passing through coil L2 for a given instant of time. More particularly, the dotted elliptical lines represent lines or paths of equal magnetic intensity surrounding coil L2. It will be appreciated that only a portion of these lines are illustrated in FIGS. 9A and 9B. Furthermore, the elliptical shape may be somewhat distorted in the illustration from that which would actually result by a current I passing through coil L2. Moreover, the field lines illustrated would extend cylindrically around coil L2 in three dimensional fashion, but have been illustrated as shown for simplicity of discussion.

It is known that a current passing through a wire results in a magnetic field surrounding the wire, and which encircles the wire in accordance with the right-hand rule. When a wire is formed in the shape of a coil, the magnetic field resulting from the current through each loop in the coil collectively produces a magnetic field of greater intensity, and is shaped like that shown in FIGS. 9A and 9B. As illustrated, the magnetic field lines are symmetric about a plane (illustrated in phantom along line x—x) that bisects coil L2. The space above this plane has been denoted as region I while the space below the plane has been denoted as region II. As can be appreciated, the magnetic field within coil L2, as illustrated by the flux lines, is concentrated and diverges outside coil L2 resulting in a disperse magnetic field.

Coils L1 and L3 are disposed symmetrically within the magnetic field generated by coil L2. Since the current I passing through coil L2 is an oscillating current (as described in connection with FIG. 2), the magnetic field generated by coil L2 will be an oscillating field. As is known, an oscillating magnetic field passing through coil L1 will induce a voltage (in accordance with the right-hand rule) across the terminals of coil L1. In the absence of any electromagnetic interference, the voltage induced across the terminals of coil L1 will equal the voltage induced across the terminals of coil L3, since they are symmetrically disposed within the magnetic field generated by coil L2. The coils L1 and L3 may be disposed in different physical positions as illustrated by coils L1' and L3', so long as their disposition is symmetric about coil L2, thereby ensuring an equal magnetic field passing through the coils L1 and L3 (or L1' and L3').

Preferably, coils L1 and L3 are disposed substantially adjacent to coil L2 as shown in FIG. 9B. This configuration best utilizes the concentrated magnetic field near coil L2 to achieve the most accurate results. That is, by disposing coils L1 and L3 in dispersed regions of the magnetic field as shown in FIG. 9A, exceeding small voltages will be induced across the terminals of the coils. As a result, the system is more susceptible to error, for example, due to variations in component tolerances. As illustrated in FIG. 9B, aligning coils L1 and L3 immediately adjacent coil L2 results in the passage of substantially the entire magnetic field generated by coil L2 through both coils L1 and L3. As a result, substantial voltages are induced across the terminals of the coils L1 and L3 and thereby this configuration provides more accurate results.

In the preferred embodiment, coils L1 and L2 and coils L2 and L3 are separated by a distance appropriate for a range of coin thicknesses, providing just enough space to permit the sample coin C1 and test coin C2 to be interposed between the coils. As shown in FIG. 9B, a sample coin (or token) C1 is interposed between coils L1 and L2. The magnetic field generated by coil L2 passes through coin C1, inducing eddy currents within the coin. The eddy currents, in turn, induce magnetic fields that oppose the magnetic field generated by coil L2, thereby attenuating the magnetic field generated by coil L2 in the region surrounding the coin C1. As can be appreciated, the magnetic field resulting from the eddy currents, and thus, the collective magnetic field surrounding the coins is a very complex field and not readily lended to illustration. Thus, the illustration of FIG. 9B has been simplified by illustrating a region in phantom line denoted as Y, in which the magnetic field resulting from the current passing through coil L2 is attenuated by the magnetic field resulting from eddy currents within the coin Cl. As is shown by the overlap of region Y with coil L1, due to the disposition of coin C1 adjacent coil L1, the field passing through coil L1 is attenuated and thus the voltage induced across the terminals of coil L1 is less than the voltage induced across the terminals of coil L3. Therefore, a net voltage is provided at the output of difference amplifier 14 (indicating a mismatch of coin C1 and C2).

Figure 4B:
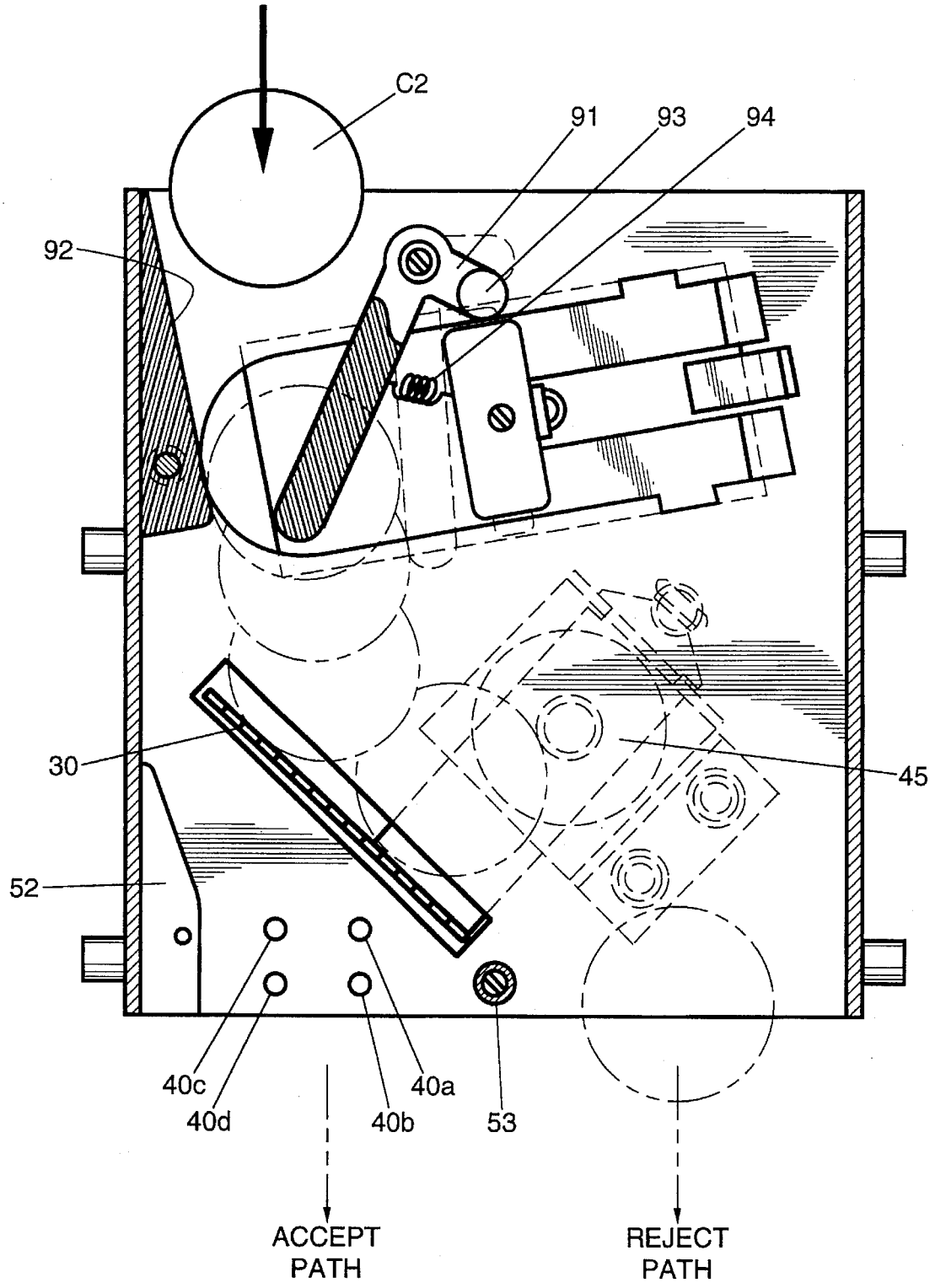
FIG. 4B is a mechanical diagram illustrating a coin guide constructed in accordance with the present invention, in relation to the coin sensor of FIG. 4A.

A test coin inserted into the coin operated device is directed between coils L2 and L3 by a coin guide. As shown in FIG. 4B, the guide includes a coin guiding arm 91 which is biased by a weight 93 or spring 94 to pivot into the travel path of the test coin and engage a coin as it begins its descent through the sensor coils. This arm 91 serves as a stabilizing device for the falling coin C2 against a reference rail 92 to maintain the coin C2 in a position symmetric with sample coin C1. Specifically, the weight 93 or spring 94 are matched to a given coin, so that the weight of the coin C2 will be sufficient to bias the guiding arm 91 to open enough to permit the coin C2 to pass through. However, the free-fall of the coin C2 will be biased against the reference rail 92 during its descent so that an adequate comparison to the test coin C1 is made. As the coin C2 passes between the arm 91 and the reference rail 92, there is a point in time when coin C2 is symmetrically disposed with the sample coin C1, assuming the coins are the same in physical characteristics. Different weights or spring tensions may be utilized for coins of various weight.

When the coins C1 and C2 are similar, the magnetic field generated by coil L2 and passing through coil L3 will be attenuated in a similar fashion as that passing through L1. Therefore, the voltage induced across the terminals of coil L3 will be reduced a corresponding amount and the output of differential amplifier 14 will again be substantially zero. This signals that a valid test coin C2 (i.e., a coin matching sample coin C1) has been inserted into the coin operated device), and accept gate 30 will open to allow test coin C2 to travel into the accept path. When the test coin C2 is of a type that does not substantially match (mass and physical properties) the sample coin C1, the magnetic field attenuation at coil L3 sufficiently differs from the attenuation at coil L1, thereby resulting in a voltage output from difference amplifier 14 sufficient to indicate that coins C1 and C2 are dissimilar. In this situation, the accept gate 30 will direct the coin to the reject path, which may pass the coin C2 to a coin return provided in the coin operated device.

The structure of the coin guiding and accepting device of FIG. 4B is substantially similar to that described in U.S. Pat. No. 4,437,558. Having already incorporated that patent by reference, this structure will not be described again. However, a principal difference between the structure disclosed in the '558 patent and the present illustrated embodiment is the inclusion of spring 94. Applicants have found that the use of a spring 94 rather than a weight 93 realizes a space savings in the device compared to varying size weights, and provides a consistent force around the moment arm which makes it more reactive to control the coin as compared to the weighted design which is gravity and position dependent.

As the coin C2 passes the guide arm 91 the accept gate 30 will direct it down either an accept path or a reject path. The accept gate 30 is activated by an electro-magnetic solenoid 45 which in turn is controlled by control circuit 32 (FIG. 1) and output 44. The control circuit 32 will activate the solenoid 45 only upon detection of a valid coin C2. Unless activated by the control circuit 32, the solenoid 45 will hold the accept gate 30 is its normal position, as shown in FIG. 4. Thus as all invalid coins fall past the guide arm 91, they will routinely be directed down the reject path. When, however, a valid coin C2 is detected, the control circuit 32 will energize the solenoid 45 to move the accept gate 30 so as to direct the valid coin down the accept path. Once the coin C2 has passed, the solenoid 45 will return the accept gate 30 to its normal position.

To more particularly describe this, it is understood that coins such as quarters, nickels, dimes, pennies, and even tokens comprise differing masses and differing alloys. Thus, magnetic fields passing through these coins of differing sizes and alloys will generate eddy currents of differing magnitudes. Thus, the corresponding magnetic fields induced by the eddy currents will be of different intensities and thus the attenuation of the magnetic field generated by coil L2 will be different at coils L1 and L3 for different coins.

A significant feature of the present invention lies in the electrical interrelation of coils L1, L2, and L3. Significantly, the balanced bridge configuration of coils L1 and L3 provides a common noise rejection that improves the resistance of the present invention to extraneous electromagnetic radiation. More specifically, it is known that electromagnetic interference emanating from an external source (i.e. external to the coin operated device) affects the magnetic field generated by coil L2. However, the effect of the EMI on the magnetic field will be equal in the regions of both coils L1 and L3. Thus, whether the electromagnetic interference operates to increase or attenuate the magnetic field of coil L2 its affect on the induced voltages across terminals of coils L1 and L3 will be the same. Passing these voltages through the difference amplifier 14 renders the affects of such electromagnetic interference transparent to the operation of the present invention.

Returning to the description of FIGS. 1 and 3, the difference amplifier 14 may be a two stage amplifier as shown in FIG. 3. In the illustrated embodiment, the first stage of the amplifier 14 includes operational amplifier 27 and has a gain of 10, while the second stage has a gain of 100 for a net amplifier gain of 1000. Thus, the difference between the voltages induced across the terminals of coils L1 and L3 is amplified 1000 times, and exceeding small changes in these induced voltages may, therefore, be detected. It is noted that the component values disclosed in the embodiment of FIG. 3 reflect the disposition of coils L1 and L3 immediately adjacent coil L2. If, however, coils L1 and L3 are disposed in more distant locations of regions 1 and 2 (see FIG. 9A), it may be desired to change the component values for the difference amplifier 14. It may, for example, be desired to provide a greater overall amplification. While specific component values have been presented in connection with the illustrated embodiment, it is significant to note that, consistent with the concepts and teachings of the present invention, other component values may be used. In this regard applicants emphasize that the objective is to achieve a maximum signal to noise ratio.

As shown in FIG. 1, the output of difference amplifier 14 is input to a control circuit 32. Preferably, the control circuit 32 is based around a micro-controller to provide programmed control of the operation of the coin operated device. Alternatively, the control circuit 32 may be based around a microprocessor or even discrete elements configured to effect the functionality prescribed by the present invention.

As illustrated, the control circuit 32 has several inputs and several outputs, each of which will be discussed in further detail below. The inputs include a sensitivity adjustment 42 and INHIBIT line and inputs from sensors 40. The inhibit line is generated from a source (not shown), and provides a means of disabling the operation of the coin operated device. For example, a switch or other means may be provided in an externally accessible location (although preferably hidden) on the coin operated device, and may be switched off to disable the device from accepting coins. This permits disabling the device without having to remove power. When disabled, or inhibited, the device merely passes coins inserted through the intake directly through to a coin return.

The selectivity adjustment is provided by potentiometer 42 connected, for example, between a voltage source +V and Ground. Due to varying component tolerances, the output of difference amplifier 14 will rarely be precisely zero (even though coins C1 and C2 are identical). Instead, the output of difference amplifier 14 will typically be at least some small value. Potentiometer 42 is provided to set a comparison voltage on line 43 for the output of difference amplifier 14. For example, potentiometer 42 may be adjusted to a position so that a voltage of one-half volt is applied to signal line 43. The control circuit 32 may then compare signal line 43 with the output of difference amplifier 14, whereby any value output from difference amplifier 14 less than one-half volt is treated as zero signifying a match between coin C1 and C2. Values output from difference amplifier 14 exceeding the value selected by potentiometer 42 would signify mismatched coins C1 and C2.

As previously mentioned, when the control circuit 32 determines that coins C1 and C2 match, it controls accept gate 30 to release the test coin C2 so as to accept the coin in the coin operated device. More specifically, the control circuit 32 has an output 44 that controls a solenoid 45 which in turn controls the operation of accept gate 30. When a voltage is applied by the control circuit 32 to line 44, the solenoid 45 energizes to open accept gate 30 and thus allow coin C2 to continue travel to the accept path. When the voltage applied to signal line 44 is substantially zero, solenoid 45 de-energizes or remains off, and accept gate 30 is spring biased to close and deflect the failed test coin to the reject path. Rejecting coins in this fashion alerts the user that the coin or coins have not been counted and should be reinserted into the device. Also output from the control circuit are SENSE, CREDIT and TILT signal lines.

As will be appreciated by those skilled in the art, the SENSE line is preferably provided for retrofit purposes and indicates that a valid coin has been inserted. The CREDIT pulse signifies that a test coin C2 has properly passed through the sensors 40, described below. Significantly, the presence of a SENSE pulse with no corresponding CREDIT pulse indicates a possible warning state. For example, the accept gate 30 may not be properly functioning. The TILT signal, like the CREDIT signal, is generated in response to sensors 40, and reflects the improper passage of a coin C2 past the sensors. To better describe these conditions, the operation of the sensors 40 will be more fully described below.

The sensors 40 are illustrated diagrammatically as four circles 40*a* through 40*d*, which are aligned with corresponding emitters 41*a* through 41*d*. These emitters 41 and sensors 40 may be realized by a wide variety of devices. In the preferred embodiment, these devices are realized by optically coupled devices, such as a light emitting diode (LED) emitter-detector pairs. Thus, four light emitting diodes are directed to illuminate across the path of the coin (as illustrated in FIG. 1) to four aligned detectors, or sensors 40*a* through 40*d*. Schematically, or electronically, the sensors may be implemented in a number of forms. For example, a transistor Darlington configuration, wherein detecting the illuminated LED biases the transistors so as to turn them on. As the coin crosses the path between an aligned emitter and sensor pair, the transistors of the Darlington pair would turn off. The state of the transistors, in this example, thus determines whether a coin C2 is presently passing between aligned emitters and sensors. Regardless of how the particular electronics are implemented, the ultimate effect is to have an electrical signal line that transitions between states (i.e., high and low) to reflect whether a coin C2 is presently passing between emitters 41 and sensors 40.

To more particularly describe the sensors 40, reference is made to FIGS. 4 through 7. FIG. 4A diagrammatically illustrates a side view of the sensor, or coin identifier, region of the present invention, and further illustrates the passage of a coin past the sensors 40*a* through 40*d*. As illustrated by the dashed lines, the coin C2 travels along a path defined by the edges of the coin (lines 50*a* and 50*b*) and having a center line 51, coincident with the center of the coin C2. The coin C2 is directed down a chute by guides, including guides 52 and 53, which direct the coin C2 past sensors 40*a* through 40*d*.

More specifically, the sensors 40*a* through 40*d* are preferably spaced apart so that two sensors 40*a* and 40*b* are vertically offset (i.e., offset in the direction of the coin C2 travel), and are disposed between the centerline 51 and a first outer boundary or edge 50*a*, in relation to the travel path of the coin C2. Sensors 40*c* and 40*d* are similarly disposed on the opposite side of the traveled path. That is, between the centerline 51 and outer boundary 50*b*. The preferred spacing just described is a nominal spacing. As will be understood by those skilled in the art, a four sensor embodiment allows a certain amount of deviation from the nominal spacing described.

Figure 5A:
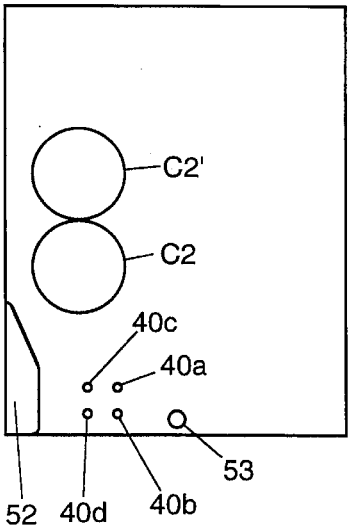
FIGS. 5A–5C illustrate the operation of the preferred coin sensor, where two coins pass the sensor in immediate succession.
Figure 5B:
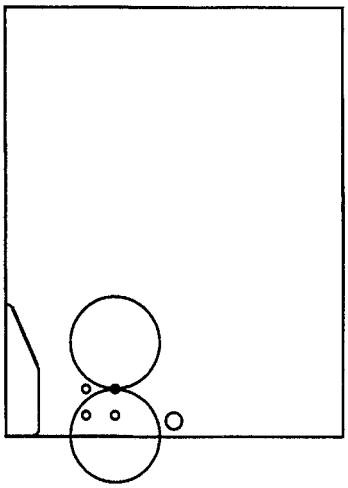
Figure 5C:
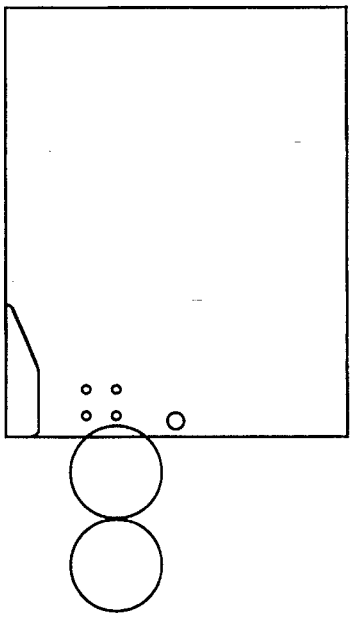

Furthermore, by providing four sensors disposed in the foregoing manner, it can be appreciated that improved coin sensing is achieved. Such improved coin sensing is important for several reasons. First, it detects double counting. This anomaly occurs where two or more coins have been inserted into the coin operated device in immediate succession. The first coin C2 is engaged by the guide arm 91 as it enters the sensor coils, and before the coin detector 10 properly identifies the coin C2, the subsequent coin "catches up with" the first coin. The first coin as well as the subsequent coin can be sensed as valid coins as they pass through the coin detector. This anomaly is illustrated in FIGS. 5A through 5C, which shows the passage of two successive and adjacent coins past the sensors 40*a* through 40*d*. FIG. 5B best illustrates the potential problem with two coins passing the sensors 40 in immediate succession. More particularly, the anomaly occurs when two coins pass the sensors 40 in immediate succession, and align with the sensors. In this regard, reference is made to FIGS. 6A through 6C which illustrate the same phenomena in a prior art device.

The prior art is characterized by two, rather than four, vertically spaced sensors. Vertically spacing the sensors in this manner provides adequate detection for anomalies such as those resulting from tilting the coin operated device, or trying to cheat the device using the coin on a string gimmick. The vertically spaced sensors may properly monitor that a coin first passes the top sensor then the bottom sensor, in that order. To illustrate this operation, consider that the sensors are in an open state when no coin is present (or crossing the path of the sensors) and closed when a coin presence is detected. In this regard, as a coin normally passes the two vertically spaced sensors, the first sensor will close followed by the second sensor closing. Then, the first sensor will open, indicating the passage of the coin, followed by the second sensor opening. If it is detected that, after both sensors have closed, that the second or lower sensor opened followed by the first sensor opening, or if both sensors are open and it is detected that the second sensor closed followed by the first sensor, then an error has occurred, since neither of these situations occur with a coin falling (in normal fashion) through the device. The error being caused either by the coin operated device being improperly tilted, or an attempt to cheat the device by some gimmick.

Figure 6A:
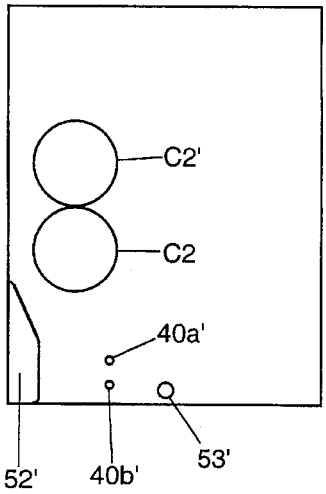
FIG. 6A PRIOR ART
FIGS. 6A–6C illustrate operation, similar to that in FIGS. 5A–5C, of a coin sensor in the prior art.
Figure 6B:
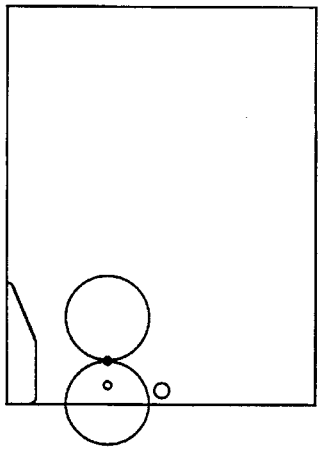
FIG. 6B PRIOR ART
Figure 6C:
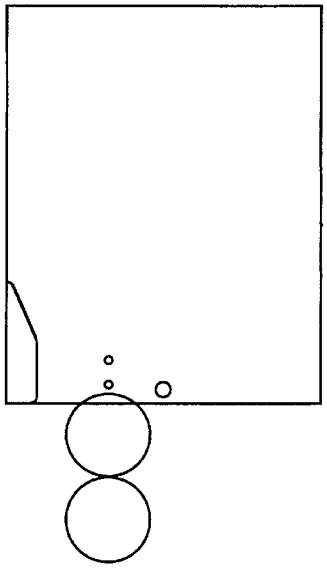
FIG. 6C PRIOR ART

One anomaly, however, not detected in the prior art is that illustrated by FIGS. 6A through 6C. In a situation where two adjacent coins pass the sensors along the centerline of the coins, the sensors will open and close in the proper sequence, but will count only a single coin. Thus, if a user inserts two quarters in a coin operated device, he may be credited for only one.

This shortcoming is overcome by the sensor configuration of the present invention. Again referring to FIG. 5B, by providing sensors that are both horizontally as well as vertically displaced, the double counting situation cannot occur. Even where, as illustrated, two adjacent coins align with one pair of the vertically displayed sensors, the second pair will provide adequate identification for coin passage. Thus, where the prior art sought to identify the passage of a coin by the closure of the first sensor followed by the closure of the second sensor, the opening of the first sensor, then the opening of the second sensor, the present invention preferably groups the two sets of vertically displayed sensors. That is, the two uppermost sensors 40*a* and 40*c* and the two lowermost sensors 40*b* and 40*d* may be viewed collectively. In this way, closure of either sensor (e.g., 40*a* or 40*c*) indicates the presence of a coin. Based upon the opening and closing pattern of the various sensors, the present invention is advantageously capable of detecting various gimmicks, tilting, as well as double counting.

As illustrated in FIG. 1, the output of the sensors 40 is directed to the control circuit 32, which is preferably under the command control of a mircocontroller or microprocessor. Intelligent monitoring of the sensors 40*a* through 40*d* is, therefore, implemented under software control. It should be understood that implementation of the specific code will depend upon the particular "four optics" hardware implementation and may be achieved by one of ordinary skill in the art by reference to the diagram shown in FIGS. 8A–8C. Accordingly, the software realization will not be described in exhaustive detail herein.

Figure 8A:
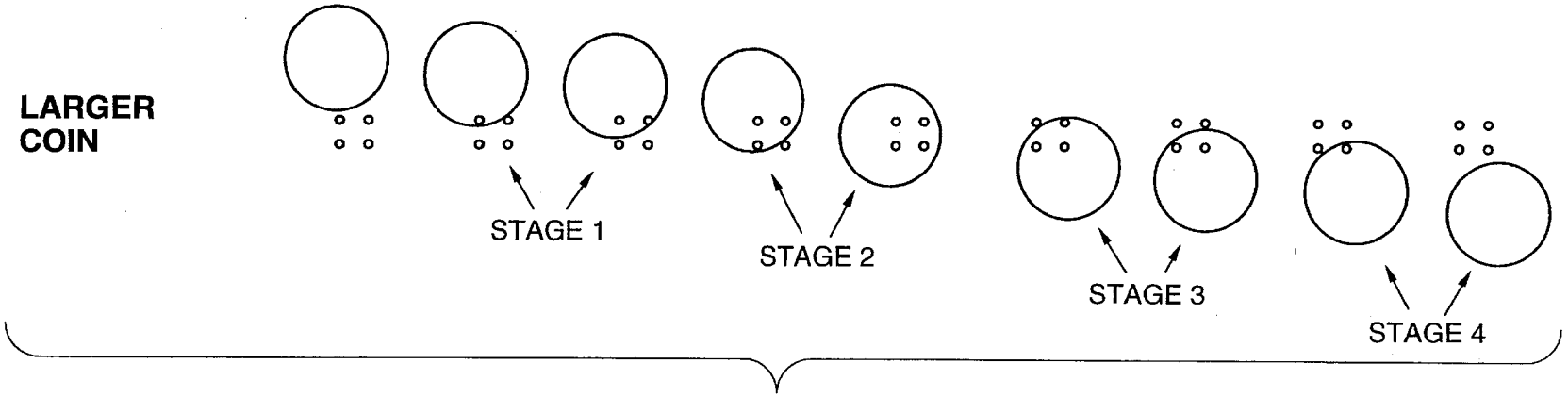
FIG. 8A is a diagram illustrating the operation of the coin sensor with a relatively large-sized test coin.
Figure 8B:
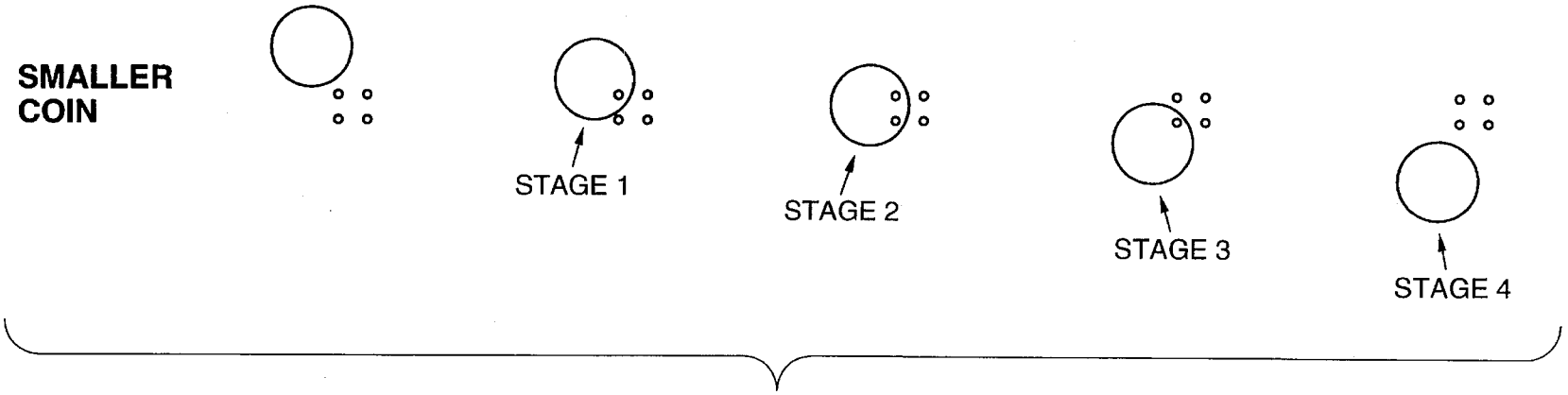
FIG. 8B is a diagram illustrating the operation of the coin sensor with a relatively small-sized test coin.
Figure 8C:
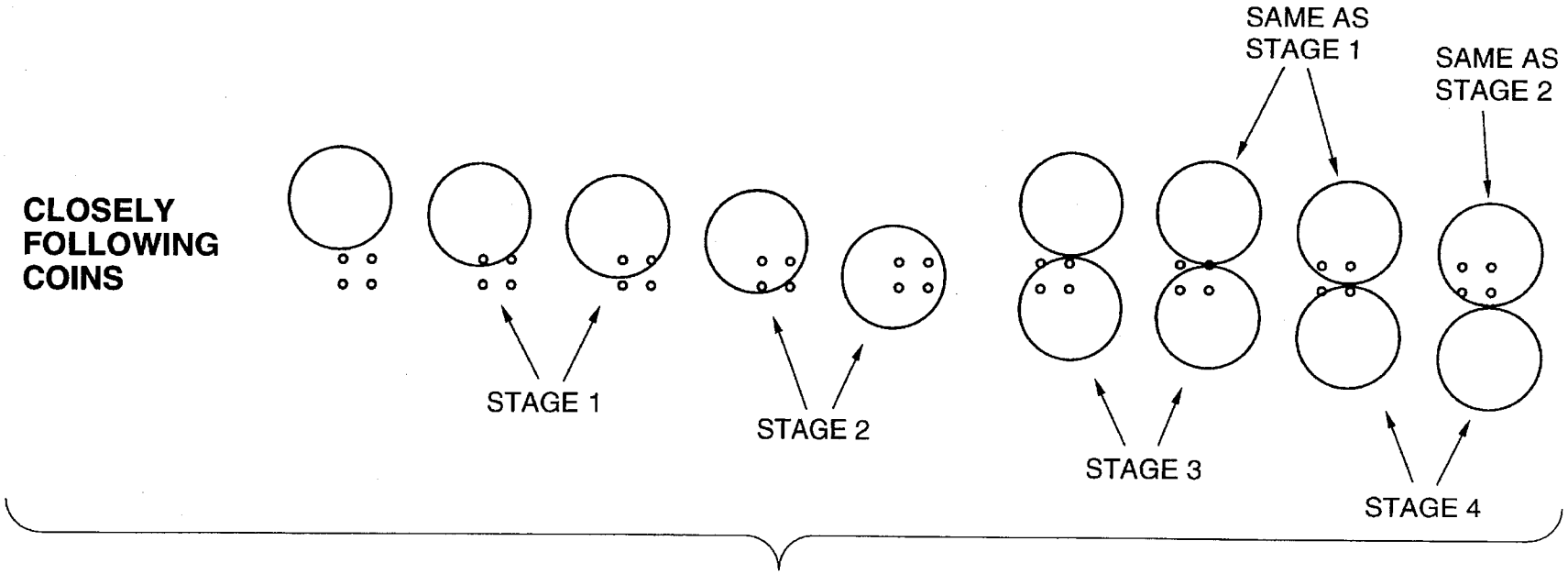
FIG. 8C is a diagram illustrating the operation of the detection of a condition when two coins pass the sensors in immediate succession.

Turning now to FIGS. 8A–8C, the operation of the sensors 40 is illustrated. More specifically, FIG. 8A illustrates the manner in which a relatively large coin C2 free falls past the sensors 40, FIG. 8B illustrates manner in which a relatively small coin C2 free falls past the sensor 40, and FIG. 8C illustrates the sensors 40 operation when two coins free fall in immediate succession. The controller 32, which receives the electrical signal output from the sensors 40 is generically programmed to detect all valid situations, whether the coin is a relatively large coin or a relatively small coin, enhancing the versatility of the system.

The coin-on-a-string gimmick and tilting the device 10 will most commonly result in an improper coin free fall, and thus an error condition. Accordingly, the controller 32 is generally programmed to sense a coin properly free falling past the sensors 40*a*–40*d*. This is achieved by identifying four general stages or positions of coin travel. The first stage is identified by one or both of the top optics having become blocked by the passage of a coin C2. The second stage is identified by one or both of the bottom optics having become blocked. The third stage is identified by one or both of the top optics becoming clear, which assumes that a valid coin C2 is sufficiently sized and positioned so that it will simultaneously block at least one top and one bottom sensor at some point. Finally, the fourth stage is identified by one or both of the bottom optics having become clear. Proper coin passage is characterized by the system proceeding sequentially from stage 1 through stage 4. Furthermore, the system must proceed through the stages in a predetermine amount of time, whereby the controller 32 generates a CREDIT pulse. Otherwise an invalid condition has occurred and the controller generates a TILT pulse.

As illustrated in FIG. 8A, which illustrates the passage of a relatively large coin C2, the sensors 40*a*–40*d* are blocked and cleared as the coin C2 passes. It is appreciated that the coin C2 does not necessarily align precisely with the sensor pairs. Thus, as illustrated, sensor 40*a* is blocked before sensor 40*c*. Similarly, sensor 40*c* may be blocked before sensor 40*a*. And, in some instances, they may be blocked simultaneously.

Alternatively, and as illustrated in FIG. 8B, a relatively small coin may fall through the accept path without simultaneously blocking both sensors in the top and bottom sensor pairs. Instead, a coin C2 may block only left-side sensors 40*a* and 40*b*. Alternatively, the coin C2 may block only right-side sensors 40*c* and 40*d*. The controller 32, nevertheless, interprets a valid coin passage, where the coin C2 passes through the stages 1 through 4, as illustrated.

In the situation where two coins are passing in immediate succession, as shown in FIG. 8C, previous optic arrangements may count both coins as only one because the touching edges of the coins may not allow the optics to clear, and thus improperly counting coins. The arrangement of optics and the controller program of the present invention will properly count coins even if they are touching edge-to-edge because only one pair of optics can be continually obstructed at the point of contact between coins, therefore allowing another pair of optics horizontally disposed from the first to properly count the successive coins.

FIGS. 8A–8C are presented merely for illustration and are certainly not intended to be exhaustive of all possible sensor conditions. Indeed, another invalid condition may arise when a user employs the coin-on-a-string gimmick. For example, a coin C2 may suspend from a string so as to block all sensors 40*a*–40*d*. Thereafter, if the user tries to remove the coin, one of the bottom sensors 40*b* or 40*d* will clear, while both top sensors 40*a* and 40*c* are blocked. The controller 32 will recognize this invalid condition as well, and generate a TILT pulse.

In view of the foregoing principles, it is expected that one of ordinary skill in the art will be able to identify all valid and invalid sensor conditions/transitions and program the controller 32 accordingly.

Having described the system hardware configuration and operation in segments, reference will now be made to FIG. 7 which is a state diagram of the entire system operation. Upon applying power to the system, the initialization state at 60 is entered. Once all sensors 40 are cleared, the system enters the IDLE state at 62. If the external INHIBIT line is activated (as previously described), the INHIBIT state at 63 is entered. The system remains in this state until the inhibit line is released or becomes inactive, at which time the system returns to the IDLE state at 62. Upon detection of a coin in the field between L2 and L3, the system enters the SENSE state at 64, where it compares the test coin C2 with a sample coin C1 to determine if the test coin is a permissible match. If an invalid coin or slug has been inserted, the system does not generate a valid null and therefore remains in the idle state, whereby the coin or slug is automatically diverted to the reject path for coin return. If, however, a valid coin is detected (valid null generated), the system enters the sense state, the accept gate 30 opens to allow coin passage through the sensors 40, the control circuit 32 pulses the SENSE line, and the system transitions back to the IDLE state 62.

Once the first optic path between either of the top sensors is broken, the system enters the SECURITY state at 65. The system may also enter this state upon a time out. That is, when a valid coin C2 has been sensed at the SENSE state 64, a timer is set. If this timer expires before an optic path has been broken, the system will pass through state 65 and onto state 66 indicating a system failure. This time out failure typically occurs, as previously mentioned, when the accept gate 30 fails to open.

In the SECURITY state 65, the system will verify the proper passage of a coin past the sensors 40, in a manner as described in connection with FIG. 8. If a valid coin passes the sensors 40 in a proper manner, the system will transition through the IDLE state to the CREDIT state at 67, where the control circuit 32 will pulse the CREDIT line, and the system will return to the IDLE state 62. If the SECURITY state 65 indicates an invalid coin passage, then system security has failed and the system will transition to the TILT state 66. There, the control circuit 32 will pulse the TILT line and the system will again return to the initialization state 60.

Figure 7:
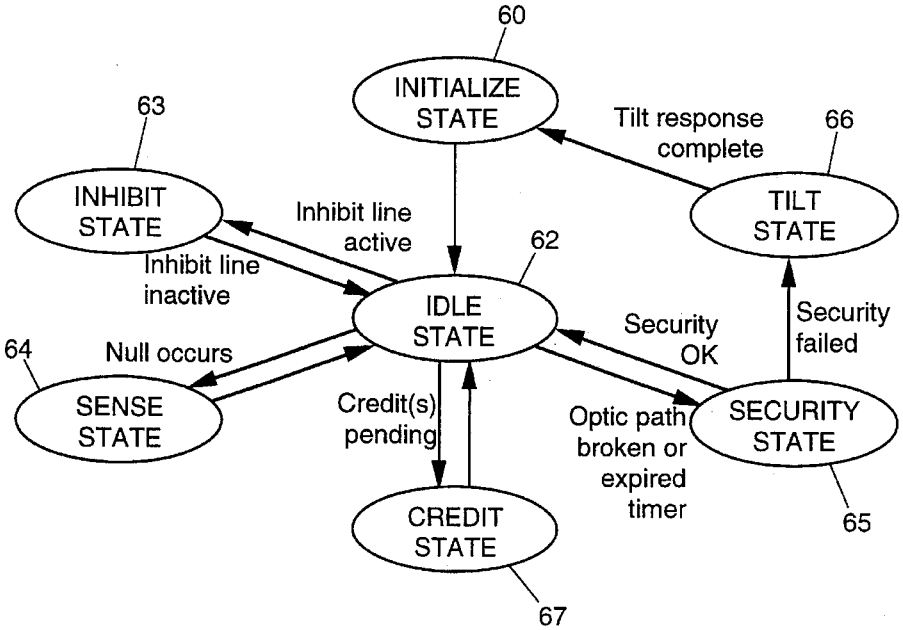
FIG. 7 is a state diagram illustrating the various states of the coin detector and identifier in accordance with the present invention.

It will be appreciated that the state diagram of FIG. 7 has been presented in a somewhat generic fashion. More particularly, in many coin operated devices, such as slot machines or gaming machines, which require the insertion of a single coin or token, the device will actually transition from the CREDIT state to an operative state wherein the device will carry out its intended function (rather than returning to the IDLE state 62). The state diagram of FIG. 7, however, has been presented to illustrated the operation of the present invention and devices that may accept multiple coins. Thus, after acknowledging the credit of a single coin, the system would return to the idle state at 62 and await the insertion of additional valid coins. In this regard, coin detector stations would be serially cascaded. For example, the sample coin of the first station may be a quarter. If the test coin does not properly match the quarter, rather than be rejected through the coin return, the test coin may be directed into the next detector station. This station may, for example, have a nickel coin disposed as the sample coin. Further stations may be cascaded in similar fashion. Only after the last station, if the test coin did not match any of the sample coins, would it be rejected through the coin return. Once a sufficient number of credits has been received, then the system would enter an operation state and carry out its operative function.

Figure 4A:
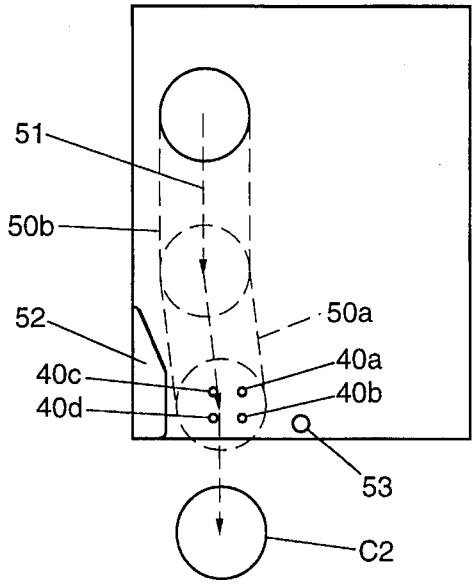
FIG. 4A is a schematic illustration of the travel path of a coin past a coin sensor.

It should be further appreciated that the four sensor embodiment illustrated in FIGS. 4 and 5 and described in the state diagram of FIG. 8 represents the preferred embodiment of the present invention. However, and consistent with the broader concepts and teachings of the present invention, a different number of sensors could be provided. For example, three sensors might be disposed in a triangular relation so as to provide both horizontal and vertical displacement components sufficient to detect and avoid the double counting anomaly. Indeed, it is possible to implement the sensing function of the present invention so as to avoid the double counting problem with two sensors. In such an embodiment, the sensors must be both vertically and horizontally displaced in relation to the travel path of the coin. In this regard, and again referred to FIG. 4A, one sensor would be disposed between the centerline 51 and a first outer boundary 50*a*. The second sensor would be vertically offset from the first sensor and disposed between centerline 51 and the opposing outer boundary 50*b*. Moreover, the guides 52 and 53 must be positioned to precisely direct the coin past the sensors. It will be appreciated that as the path of coin travel is constricted by guides 52 and 53, potential "jamming" problems may arise, whereby a coin would become lodged within the travel path inside the coin operated device. Accordingly, the four sensor embodiment described herein is preferred, in part, because it avoids this potential problem by allowing guides 52 and 53 to be sufficiently spaced so as to allow some degree of lateral freedom of movement of coin C2 as it passes through the device. Moreover, LED emitter detector pairs are relatively low cost and add only a diminimous incremental cost to the system.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A coin detector and identifier for a coin operated device comprising:

field generating means for generating an alternating magnetic field, the magnetic field having a central, concentrated region and a disperse region outside the central region, the field generating means being disposed in the central region;

first and second field detection means for detecting the magnitude of the magnetic field, the first and second field detection means being symmetrically disposed about the field generating means and being electrically connected in a balanced bridge configuration to substantially eliminate electromagnetic interference from external sources of electromagnetic radiation;

comparing means responsive to the first and second field detection means for comparing the magnitude of the magnetic fields detected by the first and second field detection means;

means for disposing a sample coin between the field generating means and the first field detection means, the sample coin being operative to alter the magnitude of the magnetic field detected by the first field detection means by an amount defined by the physical characteristics of the sample coin;

means for disposing a test coin between the field generating means and the second field detection means, the test coin being operative to alter the magnitude of the magnetic field detected by the second field detection means by an amount defined by the physical characteristics of the test coin; and coin directing means responsive to the comparing means for directing the test coin, the directing means being operative to accept test coins that match the sample coin and to reject test coins not matching the sample coin.

2. The coin detector and identifier according to claim 1, wherein the field generating means includes an electric coil.

3. The coin detector and identifier according to claim 1, wherein the means for disposing the test coin include means for directing the test coin to free fall between the field generating means and the second detection means.

4. The coin detector and identifier according to claim 1, wherein the directing means include a gate disposed downstream of the field generation means and detection means for alternatively accepting the test coin or rejecting the test coin by directing the test coin to a coin return.

5. The coin detector and identifier according to claim 1, wherein the means for disposing the test coin include a guide configured to dispose the test coin between the field generating means and the second detection means in symmetric relation with the sample coin.

6. The coin detector and identifier according to claim 5, wherein the guide includes a spring tensioned to bias the guide into the path of the test coin.

7. The coin detector and identifier according to claim 6, wherein the spring is tensioned so that the weight of the test coin is sufficient to move the guide from the path of the test coin, whereby the test coin will pass the guide.

8. The coin detector and identifier according to claim 1 further comprising:

first and second sensing means disposed downstream from the coin directing means for detecting the presence of the test coin;

guide means for directing the test coin past the first and second sensing means, the test coin travelling along a path defined by a centerline coincident with the center of the test coin and by first and second outer boundaries disposed on either side of and parallel to the centerline, the first and second boundaries each being tangential to one of the diametrically opposite edges of the test coin, the first sensing means being disposed between the centerline and the first outer boundary and the second sensing means being disposed between the centerline and the second outer boundary; and processing means responsive to the first and second sensing means to analyze the travel path of the test coin.

9. The coin detector and identifier according to claim 8 further comprising:

third and fourth sensing means for detecting the presence of the test coin, the third sensing means being disposed between the centerline and the first outer boundary, and the fourth sensing means being disposed between the centerline and the second outer boundary.

10. The coin detector and identifier according to claim 9 wherein the third sensing means is vertically displaced from the first sensing means; and the fourth sensing means is vertically displaced from the second sensing means.

11. The coin detector and identifier according to claim 1, wherein the first and second detection means include electric coils which are operable to provide an induced voltage across a pair of terminals, the induced voltage representative of the surrounding magnetic field.

12. The coin detector and identifier according to claim 11, wherein the comparing means includes an amplifier disposed to amplify the differential between the voltages induced on the terminals of the electric coils.

13. The coin detector and identifier according to claim 12, wherein the comparing means includes a control circuit that is responsive to an output of the amplifier.

14. The coin detector and identifier according to claim 13, wherein the control circuit is operative to reject the test coin when the output of the amplifier is greater than a predetermined value.

15. A coin detector and identifier for a coin operated device comprising:

field generating means for generating an alternating magnetic field, the magnetic field having a central region and first and second outer regions, the field generating means being disposed in the central region;

first and second field detection means for detecting the magnitude of the magnetic field in the first and second outer regions, the first and second field detection means being symmetrically disposed about the field generating means and being electrically connected in a balanced bridge configuration to substantially eliminate electromagnetic interference from external sources of electromagnetic radiation, wherein the first field detection means is disposed in the first outer region and the second field detection means is disposed in the second outer region;

means for disposing a sample coin between the field generating means and the first field detection means, the sample coin being operative to alter the magnitude of the magnetic field in the first outer region by an amount defined by the physical characteristics of the sample coin;

means for disposing a test coin between the field generating means and the second field detection means, the test coin being operative to alter the magnitude of the magnetic field in the second outer region by an amount defined by the physical characteristics of the test coin;

comparing means electrically connected to the first and second field detection means for comparing the magnitude of the magnetic fields detected in the first and second outer regions and for generating a control signal indicative of whether the magnetic field detected by the second detecting means has been altered by the same amount as the magnetic field detected by the first field detection means; and coin directing means responsive to the control signal generated by the comparing means for directing the test coin, the directing means being operative to accept test coins when the control signal indicates that the magnetic field detected by the second field detection means has been altered by the same amount as the magnetic field detected by the first field detection means, and to reject test coins when the control signal indicates that the magnetic field detected by the second field detection means has been altered by a different amount then the magnetic field detected by the first field detection means.

16. A coin detector and identifier for a coin operated device comprising:

field generating means for generating an alternating magnetic field, the magnetic field having a central, concentrated region and a disperse region outside the central region, the field generating means being disposed in the central region;

first and second field detection means for detecting the magnitude of the magnetic field, the first and second field detection means being symmetrically disposed about the field generating means;

comparing means responsive to the first and second field detection means for comparing the magnitude of the magnetic fields detected by the first and second field detection means;

means for disposing a sample coin between the field generating means and the first field detection means, the sample coin being operative to alter the magnitude of the magnetic field detected by the first field detection means by an amount defined by the physical characteristics of the sample coin;

a first guide configured to dispose a test coin between the field generating means and the second field detection means in symmetric relation to the sample coin with respect to the field generating means, the test coin being operative to alter the magnitude of the magnetic field detected by the second field detection means by an amount defined by the physical characteristics of the test coin, the guide including a spring tensioned to bias the first guide into the path of the test coin; and coin directing means responsive to the comparing means for directing the test coin, the directing means being operative to accept test coins that match the sample coin and to reject test coins not matching the sample coin.

17. The coin detector and identifier according to claim 16 wherein the spring is tensioned so that the weight of the test coin is sufficient to move the first guide from the path of the test coin whereby the test coin will pass the first guide.

18. The coin detector and identifier according to claim 16 further comprising:

first and second sensing means disposed downstream from the coin directing means for detecting the presence of the test coin;

second guide means for directing the test coin past the first and second sensing means, the test coin travelling along a path defined by a centerline coincident with the center of the test coin and by first and second outer boundaries disposed on either side of and parallel to the centerline, the first and second boundaries each being coincident with one of the diametrically opposite edges of the test coin, the first sensing means being disposed between the centerline and the first outer boundary and the second sensing means being disposed between the centerline and the second outer boundary; and processing means responsive to the first and second sensing means to analyze the travel path of the test coin.

19. The coin detector and identifier according to claim 18 further comprising:

third and fourth sensing means for detecting the presence of the test coin, the third sensing means being disposed between the centerline and the first outer boundary, and the fourth sensing means being disposed between the centerline and the second outer boundary.

20. The coin detector and identifier according to claim 19 wherein the third sensing means is vertically displaced from the first sensing means; and the fourth sensing means is vertically displaced from the second sensing means.

* * * * *